United States Patent [19]

Sinclair

[11] Patent Number: 4,575,087

[45] Date of Patent: Mar. 11, 1986

[54] PUZZLE

[76] Inventor: Iain Sinclair, Willow House/Hildersham, Cambridge, United Kingdom

[21] Appl. No.: 538,197

[22] Filed: Oct. 3, 1983

[30] Foreign Application Priority Data

Oct. 5, 1982 [GB] United Kingdom ..... 8228474

[51] Int. Cl.[4] ..... A63F 9/06

[52] U.S. Cl. ..... 273/153 R

[58] Field of Search ..... 273/1 GA, 1 GB, 1 GC, 273/1 GD, 1 E, 1 M, 153 R, 153 S, 157 R, 157 A, 146, DIG. 27, 138 A

[56] References Cited

U.S. PATENT DOCUMENTS 4,124,881 11/1978 Haber et al. ..... 273/146
4,148,488 4/1979 Kohlhagen ..... 273/146
4,240,638 12/1980 Morrison et al. ..... 273/138 A
4,337,948 7/1982 Breslow et al. ..... 273/1 GC

FOREIGN PATENT DOCUMENTS 3116973 11/1982 Fed. Rep. of Germany ... 273/DIG. 27

*Primary Examiner*—Richard C. Pinkham
*Assistant Examiner*—Vincent A. Mosconi
*Attorney, Agent, or Firm*—Trexler, Bushnell & Wolters, Ltd.

[57] ABSTRACT

A puzzle comprises a cube having translucent faces with a light source behind each face. Gravity-sensitive or orientation-sensitive switches such as mercury switches, are connected to an electronic circuit acting to compare the switching states and switching movements of the switches with a programmed sequence held in a memory to determine whether and which of the light sources to illuminate. In use of the puzzle the faces will light up when a predetermined sequence of rotations about three orthogonal axes are performed correctly to match the switching sequences with the stored sequence.

13 Claims, 12 Drawing Figures

PUZZLE

BACKGROUND OF THE INVENTION

The present invention relates to a puzzle, which term will be understood herein to relate to a mechanical, electronic or combined electronic and mechanical device which has to be manipulated according to predetermined rules in order to achieve a certain result. Purely mechanical puzzles have been known for a long time, and prior art examples of mechanical puzzles include devices comprising a plurality of interlocking or interfitting parts, which may be made from any suitable material. Puzzles comprising integers of bent metal or shaped wood or plastics which have to be fitted together or released from one another in a particular order are well known.

The use of purely mechanical puzzles can develop physical skills, particularly the sense and recollection ion of three-dimensional orientation. One such three-dimensional puzzle which has recently met with considerable success is the so-called "Rubic-cube" which is an assembly of interfitting components having coloured faces which can be moved relatively with respect to one another across the faces by means of an interior spherical joint to which all the components are connected. The six faces of the cube have elements with six different characteristic colours which can be moved by relative rotation of different sets of integers into a disordered array which requires skill and knowledge to reposition with all the coloured face elements of one colour on each plane face of the cube. Such a puzzle is essentially "spatial" in the sense that there is no single predetermined sequence of movements which will achieve the desired result, but rather a plurality of different relative spatial positions which have to be occupied by the various integers.

Another prior art puzzzle, operated by an electronic processor, plays the childs game known as "Simon Says" by generating a code of tones and illuminating in sequence a set of buttons, which sequence has to be matched by the player subsequently depressing the buttons in an attempt to match the original sequence.

OBJECTS OF THE INVENTION

The primary object of the present invention is to provide a puzzle which requires both three-dimensional orientation skills and memory skills to memorise sequences of movements to be performed in order to achieve a solution.

Another object of the present invention is to provide an electronic puzzle which will operate simply when it is picked up and turned over, without requiring a separate on/off switch.

A further object of the invention is to provide an electronic puzzle which will turn itself off when it is put down after play.

SUMMARY OF THE INVENTION

The present invention thus provides a puzzle comprising a polyhedron having binary indicator means on at least one face thereof, means sensitive to the orientation of said polyhedron and operative to cause said binary indicator means to change from one binary state to another when said polyhedron is turned from a first predetermined orientation to a second predetermined orientation whereby to indicate that said polyhedron has passed through a given orientation change.

The term "binary indicator means" will be understood herein to refer to an indicator having two possible indication states. In the case of an illuminable indicator the two states will be "illumination on" and "illumination off" but other indicators such as purely mechanical devices having two positions, such as tumblers, or colour coded devices which may change, for exaple, from red to green to indiate the change of state, are also to be comprehended as lying within the scope of the term.

In one embodiment of the present invention, the polyhedron may be a cube at least one face of which has inset therein a mechanical or optical binary indicator. The puzzle may be turned about axes, for example normal to the faces of the cube, in an attempt to seek the sequence required to change the state of the binary indicator to a given state. In a mechanical arrangement the binary indicator may be a lever arrangement moved from one position to another upon turning the cube about one axis so that a given face is uppermost, and which will not be affected by rotation about another axis. In the simplest embodiment the binary indicator means may be provided on only one face although preferably there may be further provided second binary indicator means on another face of the polyhedron and second orientation-sensitive means operative to cause the second binary indicator means to change from one binary state to the other when the polyhedron is turned from the said second predetermined orientation to a third predetermined orientation whereby to indicate that the polyhedron has passed through a second given orientation change. This concept can be extended to include indicators on each and every face of the polyhedron. Obviously, the greater the number of faces the larger the possible number of axes of rotation and the more complex the sequence of movements can become.

The polyhedron may for example be a tetrahedron in which case each face would have a uniquely associated axis normal thereto. Rotation about the axis normal to the face, or an axis perpendicular to such normal and lying in the plane of the face, may be chosen to effect a change of state in the binary indicator. In this case each face of the polyhedron may be provided with an associated binary indicator and the said orientation-sensitive means include means sensitive to a change of orientation of the polyhedron about each of a plurality of axes inclined to one another whereby to cause the said change of state of the binary indicator means associated with any one face only if the associated orientation change is effected as part of a predetermined sequence of such changes by turning the polyhedron about one or other of the said axes.

The said orientation sensitive means preferably include gravity sensitive switching devices operable to change over from one position to another when turned about a given axis. Alternatively, inertia sensitive means may be employed, in which case the turning movements will have to be performed briskly in order to operate the puzzle.

In the preferred embodiment of the invention the binary indicator means are illuminable indicators the binary states of which comprise an illuminated state and a non-illuminated state controlled by the switching of the said switching means. In such an embodiment the switching means are preferably electrical switches operable to supply electrical current to the illuminable indicators. Alternatively, however, the binary indicator means may be mechanical changeover devices having optically distinguishable states or states which are distinguishable in a tactile manner. This latter construction would be particularly suitable for use by the blind.

In the preferred embodiment of the invention, then, where the orientation-sensitive means include gravity sensitive electrical switches, a predetermined switching sequence may be stored in an electrical memory and there may be provided means for comparing the instantaneous switching state of the or each of the switches with the said stored switching sequence to generate electrical signals for control of the binary indicator means.

Such comparison means may include a processor capable of producing electrical signals to control the state of a plurality of binary indicators simultaneously. One solution to the puzzle may thus be a set of rotational movements about different axes such as to cause illumination of each face in turn until all faces are illuminated. The processor may be programmed to cause the indicators to change state rapidly whereby to flash on and off when certain combinations of switching movements occur. These latter combinations may, for example, comprise a plurality of movements matching the stored sequence followed by one non-matching movement. Thus if a player is progressing correctly through the sequence and makes an incorrect move one or other of the illuminated (or indeed the non-illuminated) faces may flash to indicate that a wrong move has been made. Preferably the flashing face is the last one in the sequence to light up so that the player knows that he has to move the cube back to a predetermined orientation in order to continue an attempt to find the correct sequence of rotations.

Various features and advantages of the invention defined herein will be better understood by reference to the following description of a preferred embodiment thereof made with reference to the accompanying drawings which illustrate a preferred embodiment thereof.

Figure 1:
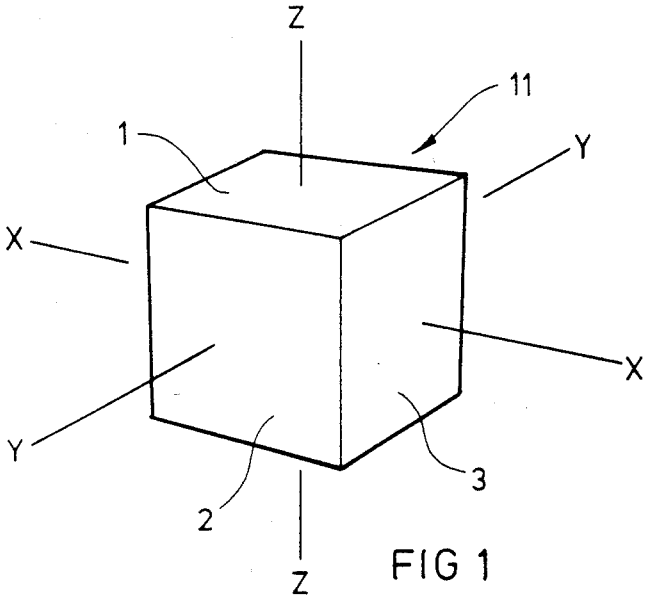
FIG. 1 is an external perspective view of a cube formed as a puzzle constituting an embodiment of the present invention.
Figure 2A:
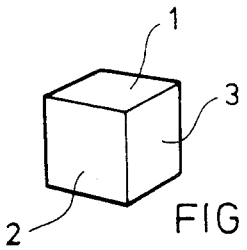
Figure 2B:
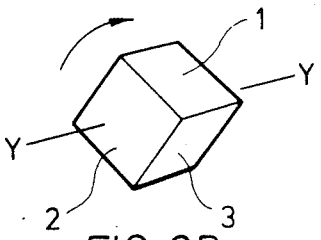
Figure 2C:
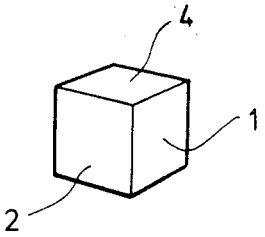
Figure 2D:
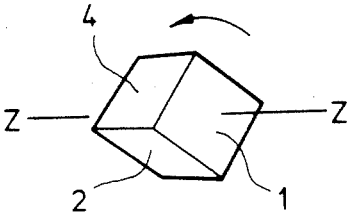
Figure 2E:
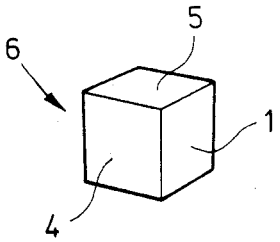
Figure 2F:
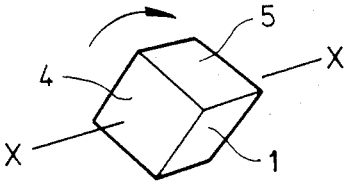
Figure 2G:
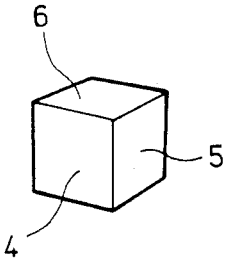
Figure 3:
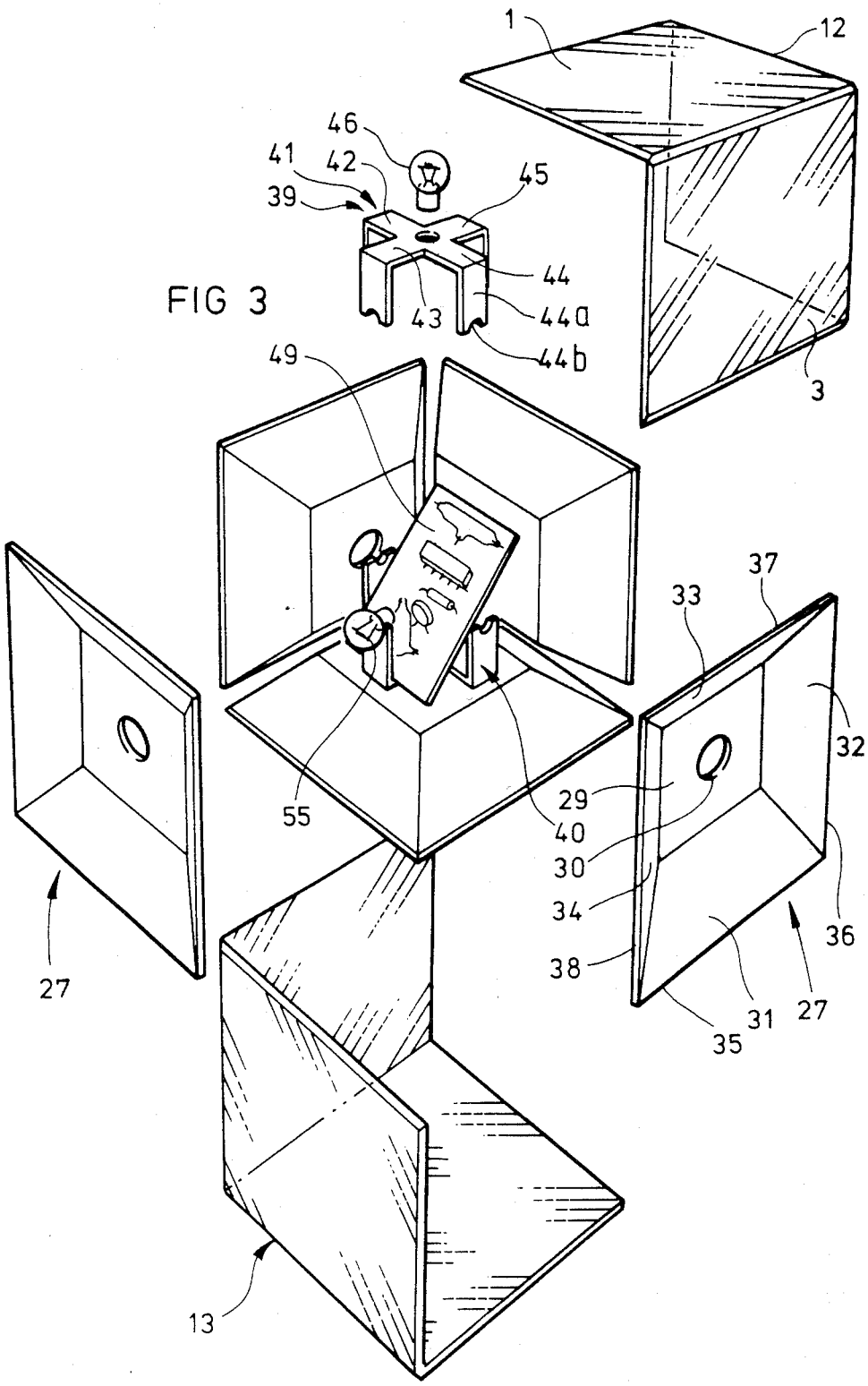
Figure 4:
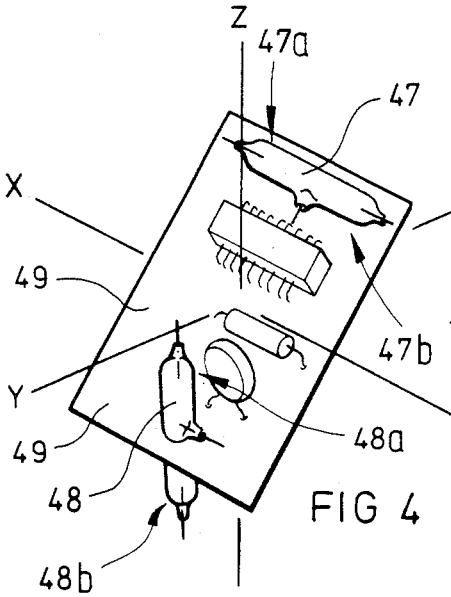
Figure 5:
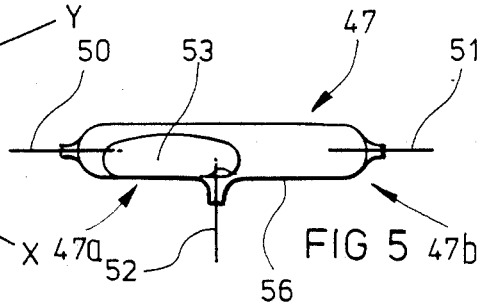

FIGS. *2a, 2b, 2c, 2d, 2e, 2f* and *2g* illustrate a sequence of movements of a cube by rotation about different axes;

FIG. 3 is an exploded perspective view of the interior components of the cube illustrated in FIG. 1;

FIG. 4 is an enlarged perspective view of a detail of FIG. 3;

FIG. 5 is an enlarged view of a detail of a component of FIG. 4; and

Figure 6:
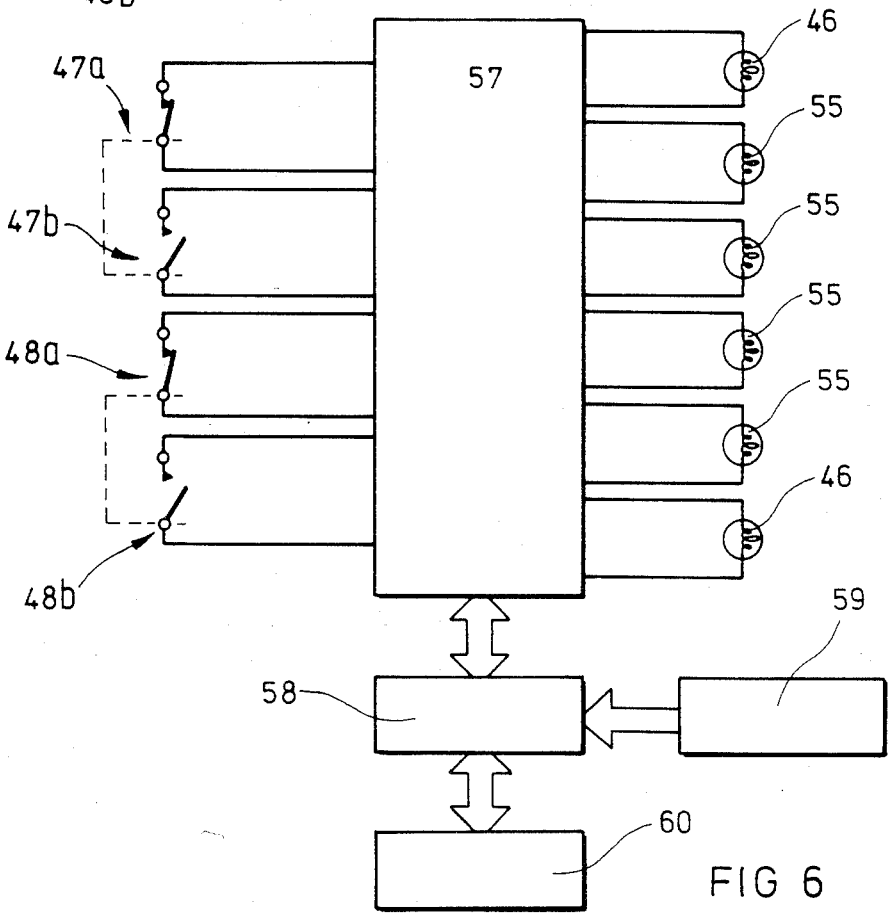

FIG. 6 is a block schematic diagram illustrating an electronic circuit for control of the puzzle of the present invention.

Referring first to FIG. 1 there is shown a cube generally indicated 11 having an internal construction such as that illustrated in FIG. 3 and turnable about each of three independent orthogonal cartesian axes indicated x y and z in a conventional manner. In FIG. 1 three faces of the cube are visible and these have been identified with the reference numerals 1, 2 and 3. The faces opposite those visible in FIG. 1 are identified as faces 4,5 and 6 respectively, these lying parallel to and opposite the faces 3,2 and 1 respectively.

For the purpose of identifying a sequence of movements, it may be assumed that the cube is orientated with the face 1 facing upwardly and each "position" of the cube in the sequence through which it has to be moved is a position with one of its faces horizontal and facing upwardly, to which position it can be moved by rotation about one of the two orthogonal axes lying in the horizontal plane in the position occupied immediately before movement to the new position. Thus, with reference to FIG. *2a,* which also shows the cube in the same orientation as in FIG. 1, the two horizontal axes about which movement may take place are the x and y axes of FIG. 1. For the purpose of this description these axes will be referred to the cube itself rather than constitute a frame of reference within which the cube is moved. In other words, rotation of the cube about the y axis as illustrated in FIG. *2b* will turn the x and z axes within the plane defined by these two axes so that, as illustrated in FIG. *2c,* the x axis becomes vertical and the z axis becomes horizontal. From the position illustrated in FIG. *2c* the two choices of rotation then lie about the y or the z axis and the face 4 is uppermost. Starting from the orientation shown in FIG. *2a* the sequence of movements illustrated can be characterised by the face numbers 1:4:5:6. The movements required to match this sequence comprise one rotation about each of the y z and x azes respectively when these are in the horizontal plane. FIG. *2d* illustrates a cube being rotated about its z axis so that the uppermost face at the end of the movement is face 5. Finally, by rotating the cube about the x axis as shown in FIG. *2f* the face 6 is moved to the uppermost position. The internal memory and switching arrangements which will be described in greater detail below may thus be set so that if the cube starts from the position 1 and is moved through the sequence illustrated in FIGS. *2a–2g* the faces 1,4,5 and 6 will illuminate in turn, but will not illuminate if the cube is turned about any other axis. Thus, at each position, there is a four-way choice of rotation in either of two directions about either of two orthogonal axes. The programmed sequence within the puzzle may be a simple four position sequence as illustrated in FIG. 2, or may be of any desired length incorporating reversals in rotational movement as well as continuing rotation about one axis.

Referring now to FIG. 3 the mechanical structure of the cube is shown. The six outer faces of the cube are formed by two identical casing halves 12,13 each in the form of three planar faces joined edge to edge with each plane lying orthogonally with respect to the other two. These elements are fitted together to form the outer casing of the cube and have transparent or translucent faces made of, for example, a suitable plastics material through which visible light can be transmitted to provide the appropriate on/off indication.

Within the cube defined by the two casing halves 12,13 are six reflectors 27 which are all identical so only one will be described in detail. This has a square flat central face 29 with a central hole 30 and the central face 29 is surrounded by four trapezoidal inclined faces 31,32,33,34 the outer edges 35,36,37,38 of which fit snugly within the periphery of the associated face of the casing element 12 or 13. The central square faces 29 of the reflectors define a cubic space within the central portion of the cube defined by the casing elements 12,13 and this is occupied by a chassis comprising two cruciform support elements 39,40 which, again, are identical to one another so only the element 39 will be described in detail. This has four orthogonal arms 42,43,44,45 lying in a common plane and each having a terminal arm portion identified by the subscript a lying at 90° to the common plane in which the arms lie. The end of each terminal arm portion 42*a*,43*a*,44*a*,45*a* has a semicircular notch 42*b*,43*b*,44*b*,45*b* which together with the associated notch in the corresponding arm of the support element 40 forms a circular hole for supporting a respective lamp bulb 55, only one of which is shown.

The central portion of each cruciform element also has a hole 41 for receiving a lamp bulb 46. The lamp bulbs 46 and 55 project through the central apertures 30 in the flat faces 29 of the reflectors to illuminate the transparent or translucent faces of the casing element 12,13, and the reflectors themselves act to isolate the light emitted by each individual light bulb from the remainder of the cube so that only one face is illuminated when one light bulb lights up.

The support elements 39,40 also carry a printed circuit board 49 which acts as a support for the batteries, the electrical circuit components and the switching devices as will be described in greater detail below. The switching devices in this embodiment are constituted by two mercury switches 47, 48 each in the form of an elongate straight tube having three contacts. The switch 47 is illustrated in greater detail in FIG. 5, and comprises a cylindrical tube 56 closed at each end and having terminal contacts 50,51 projecting through each end for contact by a bead of mercury 53 encased within the tube 56. A central contact 52 projects transversely through the tube 56 so that the bead 53 joins either the terminal contacts 50 and 52 or the terminal contacts 51 and 52 depending on its position. The tube 56 may alternatively be slightly waisted in order to provide a distinct bimorphic operation to ensure that it moves certainly from one end to the other of the tube 56 upon rotation about any axis transverse its length. As can be seen in FIG. 4 the two mercury switches 47,48 are positioned only lying parallel to the printed circuit board 49 and the other lying at an angle to the printed circuit board and perpendicular to the other mercury switch. The two mercury switches 47,48 can thus be considered as two linked switch contacts which in FIG. 6 have been shown as conventional switches and identified as 47*a*, 47*b*, and 48*a*,48*b*. The contacts 47*a*,47*b* of FIG. 6 correspond for example to the terminal pairs 50,52 and 51,52 of the mercury switch 47, so it can be seen that when the contacts 47*a* are open the contacts 47*b* will be closed and similarly, the switch 48, when the contacts 48*a* are open the contacts 48*b* will be closed. Although shown as individual switches the switch pairs 47 and 48 will in practice each have a common line connected, for example, to the central terminal 52 of the mercury switch as shown in FIG. 5.

The switch pairs 47 and 48 are connected to the input terminals of an input/output buffer 57 which is a decoder/latching circuit connected to a central processing unit 58 which can read data from a Read Only Memory 59 and communicate bi-directionally with a Random Access Memory 60.

It will be appreciated that as the cube 11 is turned about the x, y and z axes the switch contacts 47*a*,47*b*,48*a* and 48*b* will go through a set of open/closed sequences which will depend not only on the orientation of the cube 11 at any one time, but on its immediately preceding orientation. Thus, with reference to FIG. 4, the switch contacts in the mercury switch 48 will be uniquely defined because the mercury switch is in a vertical orientation so that the contacts 48*a* can only be open and the contacts 48*b* can only be closed. The mercury switch 47, on the other hand, may have the contacts 47*a* open or closed and, correspondingly, the contacts 47*b* closed or open depending on whether the preceding orientation of the mercury switch 47 was with one end or the other uppermost.

If, for example, the switch contacts 47*a* are open and the switch contacts 47*b* are closed, that is the mercury bead 53 is located to connect the terminals 50 and 52, this state will be maintained for all rotations of the cube about the x-axis and about the z-axis but rotation about the y-axis in a clockwise sense (as viewed in FIG. 4) will cause the switch contacts to change after one quarter of a revolution whereas anti-clockwise rotation of the cube will not cause commutation of the switch 47 for three quarters of a revolution namely after three different faces have been turned uppermost. Such anti-clockwise rotation of the cube, however, will cause commutation of the switch 48 after only one half of a revolution in either direction since the contacts 48*b* will open and the contacts 48*a* will close when the switch 48 is inverted regardless of the directional sense of the rotation about the y-axis or the x-axis. The on/off switching states of the four switches 47*a*,47*b*,48*a*,48*b* thus constitute binary inputs to the circuit and these can be compared by the processor 58 with a predetermined sequence stored in the ROM 59 to determine whether and which output lamp constituted by the bulbs 46,55 of FIG. 3 are to be illuminated. Information on the immediately past movements of the switches is stored in the Random Access Memory 60 for the purpose of the comparison.

Although light bulbs are illustrated in FIG. 3 as the light sources, suitable alternatives such as light emitting diodes may be used instead. Further, the central processor may include a timer (not shown) for detecting the time periods between consecutive switching movements, which timer will automatically shut down the circuit, turning off any of the lamps which are lit up if a predetermined time elapses after the last commutation so that when the puzzle is put down after play it will automatically shut ifself off after this time period, which may be, for example anything from two to five minutes. Likewise, because the device is shut down to a quiescent mode the first switching commutation which takes place can be utilised to power-up the system so that no separate switch to turn the unit on is required, it simply being necessary to pick up the puzzle and start rotating it for it to be fully operational.

The information stored in the ROM 59 may include more than one switching sequence with the programme acting to change to sequence each time a sequence has been successfully completed. In this way it will not be possible simply to memorise the previously successful sequence because this will no longer match the new sequence being operated by the processor 58.

What is claimed is:

1. A puzzle comprising a polyhedral body, binary indicator means on each face of said polyhedral body, gravity responsive switch means sensitive to a change of orientation of said polyhedral body about each of two axes inclined to one another, said gravity responsive switch means operating to cause said binary indicator means on one face of said polyhedral body to change from one binary state to another when said polyhedral body is turned from a first predetermined orientation to a second predetermined orientation and to remain in said other binary state whereby to indicate that said polyhedral body has passed through a given orientation change, memory means storing at least one predetermined sequence of changes of said gravity responsive switch means representing at least one predetermined sequence of orientation changes of said polyhedral body and, comparison means for comparing the instantaneous state of each said gravity responsive switch means with said sequence of changes stored in said memory means whereby to generate electrical signals for control of said binary indicator means to cause said change of binary state of any one indicator to said other binary state and maintenance of said indicator in said other binary state only if the associated orientation change is effected as part of said predetermined sequence of such changes by turning said polyhedral body about one or the other of said two axes about which the gravity responsive switch means associated with said one binary indicator means is sensitive, said comparison means including a microprocessor capable of producing electrical signals to control the state of a plurality of binary indicators simultaneously.

2. The puzzle of claim 1 wherein said binary indicator means are illuminable indicators the binary states of which comprise an illuminated state and non-illuminated state, controlled by the switching of said gravity responsive switch means, and by said comparison means.

3. The puzzle of claim 1, wherein said polyhedral body is a cube.

4. The puzzle of claim 1, wherein said polyhedral body is a tetrahedron.

5. The puzzle of claim 1, wherein said gravity responsive switch means include two gravity sensitive electrical switches each operable to change switching state only upon rotation about a given axis of rotation.

6. The puzzle of claim 1, wherein said binary indicators are illuminable and said microprocessor is operable to cause said binary indicators to change state rapidly, whereby to flash on and off when certain combinations of switching movements occur.

7. The puzzle of claim 6, wherein said certain combinations of switching movements comprise a plurality of movements matching said stored sequence followed by one non-matching movement.

8. The puzzle of claim 1, wherein each said binary indicator is an illuminable element which changes colour upon a change in its binary state.

9. The puzzle of claim 1, wherein said gravity sensitive switch means include mercury switches the shape of which is such that switching commutation takes place about a given axis, and rotation about at least one axis different from said given axis does not cause switching commutation thereof.

10. The puzzle of claim 1, wherein there are further provided timer means operable to de-energise such of the binary indicator means as may be energised a predetermined time after the last change of state of said orientation-sensitive means.

11. The puzzle of claim 1, wherein said polyhedral body is a cube having transparent or translucent sides within which is housed a plurality of lamps each having an associated reflector and mounted on a central chassis which also supports batteries for energisation of said puzzle, and electronic processor circuits for storing said predetermined sequence of switching movements and for effecting said comparison.

12. The puzzle of claim 11, wherein there are provided colour filters between each illuminable lamp and the associated said screen surface of said cube whereby each face lights up with a characteristic colour when illuminated.

13. The puzzle of claim 1, wherein said memory stores a plurality of switching sequences for comparison, said processor operating to select a different sequence for comparison each time a sequence has been correctly matched.

* * * * *